US006112569A

United States Patent [19]

Ossendorf

[11] Patent Number: 6,112,569

[45] Date of Patent: Sep. 5, 2000

[54] BENDING DEVICE FOR FOUR-HIGH OR MULTI-ROLL STANDS

[75] Inventor: Horst Ossendorf, Heilligenhaus, Germany

[73] Assignee: Mannesmann AG, Düsseldorf, Germany

[21] Appl. No.: 09/251,042

[22] Filed: Feb. 18, 1999

[30] Foreign Application Priority Data

Feb. 18, 1998 [DE] Germany ..... 198 07 785

[51] Int. Cl.[7] ..... B21B 29/00

[52] U.S. Cl. ..... 72/241.8

[58] Field of Search ..... 72/241.2, 241.4, 72/241.6, 241.8, 245, 246, 247, 242.2, 242.4, 243.2, 243.4, 243.6, 240, 248

[56] References Cited

FOREIGN PATENT DOCUMENTS 0 768 125 9/1996 Germany ..... B21B 29/00

*Primary Examiner*—Rodney Butler

*Attorney, Agent, or Firm*—Cohen, Pontani, Lieberman & Pavane

[57] ABSTRACT

A bending device for a rolling mill having four-high or multi-roll stands having working rolls with bearing chucks, support rolls and, as applicable, intermediate rolls arranged between the working rolls and the support rolls. First bending blocks that act bilaterally on each bearing chuck of the working rolls are run vertically in windows of the roll stand. Vertically opposite of the first bending blocks of each working roll pair are movable toward and away from each other via first piston-cylinder units. A second vertically movable bending block is movable independently of the first bending blocks via a second piston-cylinder unit supported on the roll stand so that the second bending block thereby acts bilaterally on each bearing chuck

3 Claims, 2 Drawing Sheets

BENDING DEVICE FOR FOUR-HIGH OR MULTI-ROLL STANDS

BACKGROUND OF THE INVENTION

1. Field of the Invention

The present invention relates to a bending device, and in particular a bending device for a flat rolling mill having four-high or multi-roll stands with working rolls, support rolls and, as applicable, intermediate rolls arranged between the working rolls and the support rolls. The bending device includes bending blocks run vertically in windows of the roll stand so as to act bilaterally on each bearing chuck of the rolls. Piston-cylinder units enable the vertically opposite bending blocks of a roll pair to be movable toward and away from each other.

2. Description of the Related Art

When strip material is rolled in flat rolling mills, high deformation forces are applied to the rolled material and must be absorbed as reaction forces by the roll stands. The roll stands are designed accordingly, but material deformation of the stands as well as the rolls nonetheless occurs. Although the deformation of the working rolls can be reduced by supporting the working rolls with support rolls and, in some cases, intermediate rolls that are arranged between the working rolls and the support rolls, it cannot be prevented. Without countermeasures, the bending of the working rolls toward the side away from the rolled material results in the roll gap taking on a convex cross-sectional shape so that the rolled material is more strongly deformed at the edges than in the middle.

This process can be influenced in various ways, for example, by crowning the rolls, i.e., grinding the roll barrels convexly. This allows the bending of the rolls to be largely compensated for-but only for a certain roll load.

Another common way to compensate for roll bending consists of deliberately bending a roll by use of special bending devices. The deliberate bending is directed counter to the bending that results from the roll force. The special bending devices allow the bending that results from the roll load to be bent back. Moreover, certain roll bendings can be set, so as to deliberately modify the rolled material profile.

Known bending devices, which act on the roll journals or on the chucks of the roll bearings, either expand the rolls of the roll pair toward the support or intermediate rolls, or else draw the rolls toward the rolled material. The first case is referred to as positive roll bending and the second as negative roll bending.

A generic bending device is known from European Patent Application 0 768 125 A1. Here, the bending forces are conveyed via bending blocks to the bearing chucks of the rolls, which are run on pairs of cylindrical rods that are arranged in the windows of the roll stand and whose ends are connected indirectly to the roll stand. However, this known bending device has the disadvantage that only either positive or negative bending forces can be introduced to the working rolls. This has proved disadvantageous for the rolling process, especially when a change is made from positive to negative bending, in which the working rolls can elevate from the support rolls. This leads to quality losses in the rolled material.

SUMMARY OF THE INVENTION

An object of the present invention is therefore to overcome the disadvantages of the prior art discussed above by providing a bending device for a flat rolling mill that enables both positive and negative working roll bending to take place simultaneously during a rolling process. This, advantageously permits a great variation in adjustment of a strip profile of a rolled material as well as a process-correct adjustment of the roll bending.

The flat rolling mill includes four-high or multi-roll stands with working rolls, support rolls and, in an advantageous embodiment intermediate rolls arranged between the working rolls and the support rolls. Respective bearing chucks supporting the working rolls are mounted to the roll stand. Roll stand windows are configured vertically within the roll stand.

The bending device of the present invention provides a pair of first bending blocks connected to the bearing chucks of the roll stands that are arranged so as to be vertically movable toward and away from one another. Guide pieces for slideably guiding the first bending blocks are arranged in the roll stand window and are securely connected to the roll stand via cross-bars. A first piston-cylinder unit is provided so as to move the first bending blocks which in turn are connected to the bearing chucks of the roll stands. Therefore, the working rolls are movable toward or away from one another. A second bending block is arranged bilaterally on each bearing chuck so as to be vertically movable independently of the first bending blocks. A second piston-cylinder unit is supported on the roll stand and is connected to the second bending block so as to vertically move the second bending block.

In addition to moving the working rolls toward and away from each other, the present invention advantageously enables additional bending forces to act on the working rolls that, supported on the roll stand, are directed counter to the bending forces of the first bending blocks. In this way, both positive and negative working roll bending can be simultaneously introduced, so that the profile of the rolled material is influenced in many different ways.

In one embodiment of the present invention, the second bending block is run within the first bending block. This embodiment is beneficial for reasons of space, since the structural space in the windows of the roll stand is extremely limited.

In an especially advantageous embodiment of the present invention, the first bending blocks, which are run in a sliding fashion in the guide pieces connected securely to the roll stand, are provided with flat guides in which the second bending block is movable. A bracket, projecting into the stand window, is arranged on the roll stand to support the second piston-cylinder unit for moving the second bending block.

Thus, the present invention provides for two independently movable bending blocks on the bearing chucks of the working rolls. A first bending block pair is run by the guide piece connected securely to the roll stand. Piston-cylinder units are arranged, respectively, in a bending block of the first bending block pair and connected to the other of the bending block of the first bending block pair so as to move the bending blocks. The second bending block pair is run in the first bending block pair. The second piston-cylinder units are supported securely on the roll stand and are connected to the second bending block pair so as to separately and axially move the second bending block pair. The bending device embodied in this fashion enables simultaneously positively and negatively bending of the working rolls.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
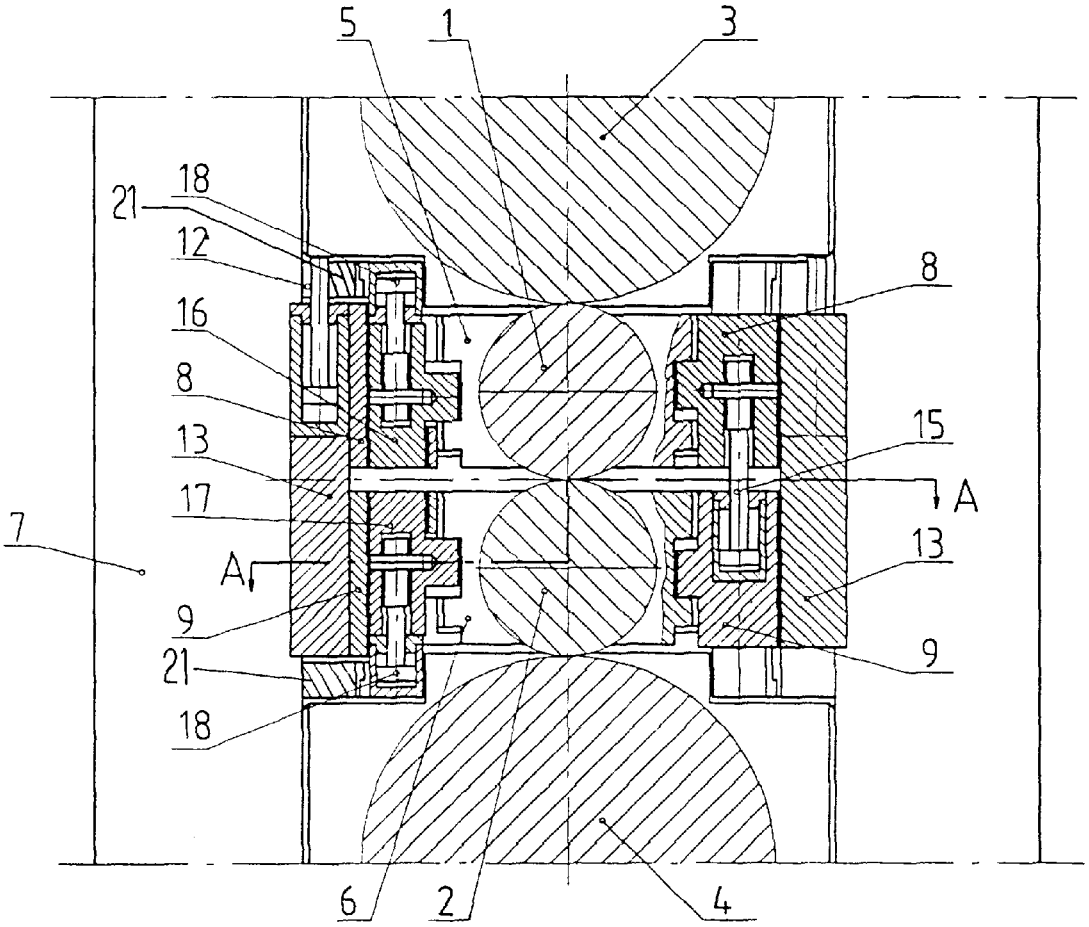
FIG. 1 shows a section of a bending device according to the present invention in a four-high roll stand, as taken along Line I—I of FIG. 2.
Figure 2:
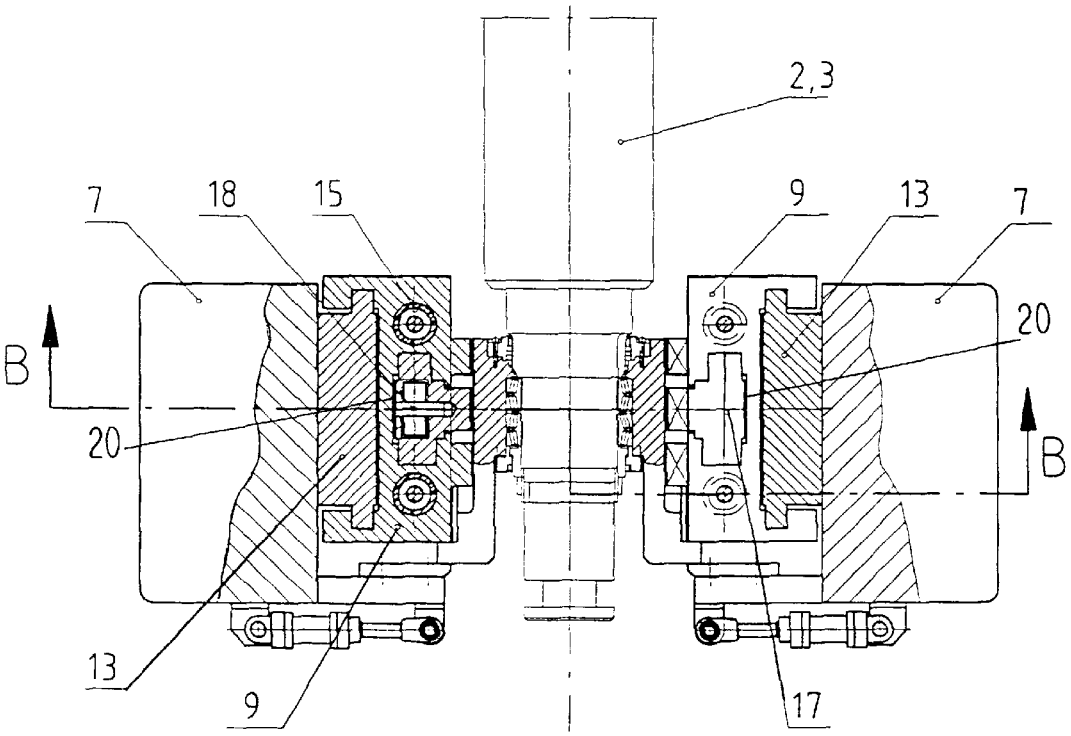
FIG. 2 shows a top view of the bending device, as taken along Line II—II of FIG. 1.

FIG. 1 shows a bending device according to the present invention for a four-high roll stand 7 having working rolls 1, 2 and support rolls 3, 4. Guide pieces 13 are arranged in a roll stand window 12, a vertical edge of the guide pieces 13 being secured to cross-bars connected to the roll stand 7. First bending blocks 8, 9, for shaping by bending a rolled material, are slideably arranged along another vertical edge of the guide pieces 13, and are located one atop the other. Bearing chucks 5, 6, rotatably supporting the working rolls 1, 2, are connected to the bending blocks 8, 9 so that by sliding the bending blocks 8, 9 vertically, the working rolls 1, 2 are moved toward or away from one another.

In order to accomplish this, two first piston-cylinder units 15 are respectively connected to the first bending blocks 8, 9. Extension of the two first piston-cylinder units 15 thereby moves the first bending blocks 8, 9 away from each other, and thus away from the rolled material, resulting in a positive working roll bending. Conversely, retraction of the two first piston-cylinder units 15 moves the first bending blocks 8, 9 toward each other, and thus toward the rolled material, which results in a negative working roll bending.

In another advantageous embodiment of the present invention, in addition to the first bending blocks 8, 9, second bending blocks 16, 17 are connected to the bearing chucks 5, 6 of the working rolls 1, 2. Flat guides 20 are provided at the first bending blocks 8, 9 for slideably guiding the second bending blocks 16, 17 so as to be separately vertically movable. Second piston-cylinder units 18 are connected securely to the cross-bars of the roll stand 7 by a bracket 21 and respectively to each of the second bending blocks 16, 17, so as to individually move the second bending blocks 16, 17 vertically in the first bending blocks 8, 9. The bracket 21 projects into the window 12. This makes possible further positive and negative working roll bending, which, combined with the working roll bending of the first bending blocks 8, 9, enables simultaneous positive and negative bending on one roll or on various rolls. This advantageously enables different curvatures to be set on the two working rolls 1, 2, for example, by which the rolled material strip cross-sectional profile is varied from convex to flat to concave.

The invention is not limited by the embodiments described above which are presented as examples only but can be modified in various ways within the scope of protection defined by the appended patent claims.

I claim:

1. A bending device which enables both positive and negative bending of work rolls simultaneously in four-high and multi-roll stands, the work rolls are rotatably supported on bearing chocks connected to a roll stand having windows, and support rolls, the bending device comprising:

first bending blocks slidably arranged vertically in the windows of the roll stand so as to act bilaterally on the bearing chocks of each pair of the work rolls;

first piston-cylinder means for moving vertically opposite of the first bending blocks of each pair of the work rolls toward and away from each other;

a second vertically movable bending block respectively arranged to act bilaterally on each bearing chock and so as to be movable independently of the first bending blocks; and second piston-cylinder means supportable on the roll stand for moving each second bending block.

2. The bending device according to claim 1, wherein each second bending block is arranged so as to be in slidable contact with one of the first bending blocks.

3. The bending device according to claim 1, further comprising:

a guide piece securely connectable to the roll stand for each of the first bending blocks, each of the first bending blocks being in slideable contact with a respective guide piece, the first bending blocks having flat guides, the second bending block being in slideable contact with the flat guides; and a bracket mountable to the roll stand so as to project into the roll stand window, the second piston-cylinder means being supported on the bracket.

* * * * *